US008749163B2

(12) United States Patent
Phadke

(10) Patent No.: US 8,749,163 B2
(45) Date of Patent: Jun. 10, 2014

(54) LED DRIVER CIRCUITS

(75) Inventor: Vijay G. Phadke, Pasig (PH)

(73) Assignee: Astec International Limited, Kwun Tong, Kowloon (HK)

( * ) Notice: Subject to any disclaimer, the term of this patent is extended or adjusted under 35 U.S.C. 154(b) by 191 days.

(21) Appl. No.: 13/240,138

(22) Filed: Sep. 22, 2011

(65) Prior Publication Data

US 2013/0076245 A1 Mar. 28, 2013

(51) Int. Cl.
*G05F 1/00* (2006.01)

(52) U.S. Cl.
USPC ..... 315/291; 315/307; 315/224; 315/185 S; 315/312

(58) Field of Classification Search
CPC ..... H05B 33/081; G05F 1/005
USPC ..... 315/291, 307, 185 S, 312, 224
See application file for complete search history.

(56) References Cited

U.S. PATENT DOCUMENTS 5,930,130 A 7/1999 Katyl et al.
6,714,429 B2 3/2004 Phadke
7,200,502 B2 * 4/2007 Gasperi et al. ..... 702/65
7,526,392 B2 * 4/2009 Gasperi et al. ..... 702/60
7,531,918 B2 5/2009 Atluri et al.
8,399,819 B2 * 3/2013 Madhani et al. ..... 250/205
2006/0274468 A1 12/2006 Phadke
2009/0105848 A1 * 4/2009 El-Sayed ..... 700/21
2009/0180220 A1 * 7/2009 Schuster et al. ..... 361/25
2010/0253245 A1 10/2010 Du et al.
2013/0063051 A1 * 3/2013 Sterling et al. ..... 315/360

FOREIGN PATENT DOCUMENTS

JP 10-248261 9/1998

* cited by examiner

*Primary Examiner* — Tuyet Thi Vo
(74) *Attorney, Agent, or Firm* — Harness, Dickey & Pierce, P.L.C.

(57) ABSTRACT

A driver circuit for one or more LEDs includes a power circuit having an output terminal, a capacitor coupled to the output terminal and a switch, and a control circuit coupled to the power circuit for controlling the power circuit. The control circuit is configured to operate the switch for coupling a resistance in series with the capacitor in response to detecting an open circuit condition at the output terminal. Additionally, or alternatively, the driver circuit may include a switched mode power supply, and the control circuit may be configured to switch operation of the switched mode power supply from a current control mode to a voltage control mode, and reduce a current setting for the current control mode, in response to detecting an open circuit condition at the output terminal.

20 Claims, 4 Drawing Sheets

LED DRIVER CIRCUITS

FIELD

The present disclosure relates to driver circuits for one or more light emitting diodes (LEDs), and LED circuits including such driver circuits.

BACKGROUND

This section provides background information related to the present disclosure which is not necessarily prior art.

Driver circuits for LED(s) typically operate in voltage regulation mode when the output is open-circuited, such as when the LED(s) are disconnected from the output for replacement. This open circuit voltage is usually greater than the voltage level at the output when LED(s) are connected. Therefore, capacitors coupled to the output may be charged to a higher voltage level during the open circuit condition, and may subsequently deliver excess energy in an uncontrolled manner to any LED(s) connected to the output while the driver circuit is energized, potentially damaging the LED(s). For this reason, some known driver circuits use a linear switch in series with the output to control the output current upon hot insertion of the LED(s). Other known driver circuits attempt to regulate the open circuit output voltage at a level that is very close the voltage level at the output when LED(s) are connected.

SUMMARY

This section provides a general summary of the disclosure, and is not a comprehensive disclosure of its full scope or all of its features.

According to one aspect of the present disclosure, a driver circuit for one or more LEDs includes a power circuit having an output terminal, a capacitor coupled to the output terminal and a switch, and a control circuit coupled to the power circuit for controlling the power circuit. The control circuit is configured to operate the switch for coupling a resistance in series with the capacitor in response to detecting an open circuit condition at the output terminal.

According to another aspect of the present disclosure, a driver circuit for one or more LEDs includes a switched mode power supply having an output terminal, and a control circuit coupled to the switched mode power supply for controlling the switched mode power supply in a current control mode or a voltage control mode. The control circuit is configured to switch operation from the current control mode to the voltage control mode, and reduce a current setting for the current control mode from a first current level to a second current level, in response to detecting an open circuit condition at the output terminal.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
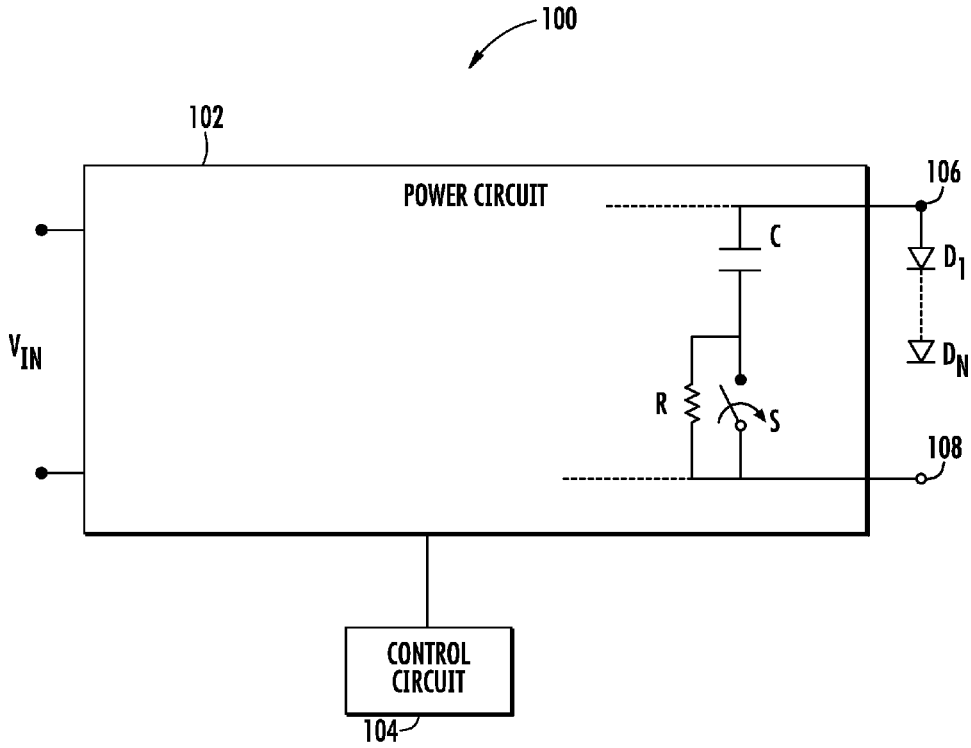
FIG. 1 is a block diagram of an LED driver circuit according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A driver circuit for one or more LEDs according to one example embodiment of the present disclosure is illustrated in FIG. 1 and indicated generally by reference number 100. As shown in FIG. 1, the driver circuit 100 includes a power circuit 102 and a control circuit 104 coupled to the power circuit 102 for controlling the power circuit 102. The power circuit 102 includes at least one output terminal 106 to which one or more LEDs $D_1$-$D_N$ may be coupled. The power circuit 102 further includes a capacitor C coupled to the output terminal 106 and a switch S.

The control circuit 104 is configured to operate the switch S for coupling a resistance in series with the capacitor C in response to detecting an open circuit condition at the output terminal 106. For example, when no LEDs are coupled to the output terminal 106, the control circuit 104 may open the switch S to couple one or more resistors, such as the resistor R shown in FIG. 1, in series with the capacitor C. When so coupled, the resistor R will inhibit current flow from the capacitor C to the output terminal 106 when one or more LEDs $D_1$-$D_N$ are subsequently coupled to the output terminal 106. In this manner, the resistor R may inhibit excessive current from flowing through and damaging the LEDs $D_1$-$D_N$, if the LEDs are coupled to the output terminal 106 when the capacitor C is charged (e.g., when the power circuit 102 is energized).

Additionally, the control circuit 104 may be configured to reduce the resistance coupled in series with the capacitor C in response to detecting one or more LEDs $D_1$-$D_N$ have been coupled to the output terminal 106. For example, the control circuit 104 may close the switch S to bypass the resistor R (and thus reduce the resistance coupled in series with the capacitor to zero) upon detecting one or more LEDs $D_1$-$D_N$ have been coupled to the output terminal 106. In this manner, the power loss associated with the resistor R can be eliminated, e.g., after the risk of excessive current flow through the LEDs $D_1$-$D_N$ has passed.

The switch S may be any suitable switching device such as, e.g., a semiconductor switch or an electromechanical switch (e.g., a relay). For example, FIG. 2 illustrates the switch S as an electromechanical switch.

Figure 2:
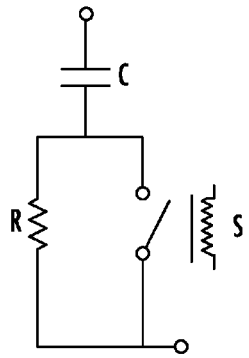
FIG. 2 is a circuit diagram of an example switch configuration of the driver circuit of FIG. 1.
Figure 3:
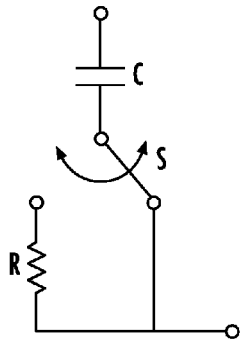
FIG. 3 is a circuit diagram of another example switch configuration of the driver circuit of FIG. 1.

Further, the switch S may be coupled in parallel with the resistor R, as shown in FIGS. 1 and 2. Alternatively, another suitable circuit arrangement may be employed for selectively coupling a resistance in series with the capacitor C using the switch S. For example, FIG. 3 illustrates an arrangement where the switch S is selectively movable between a first position with the resistor R coupled in series with the capacitor C, and a second position with the resistor R open-circuited.

If the switch S is a semiconductor switch, the resistance coupled in series with the capacitor C may be provided, at least in part, by the switch itself. For example, the switch S may be a MOSFET operated in its linear region as a precision resistor to control conduction therethrough. In that event, the resistance selectively coupled in series with the capacitor C by the control circuit 104 may be provided, at least in part, by the MOSFET switch S. As conduction through the MOSFET switch S is increased, the resistance provided by the parallel combination of the resistor R and the switch S (which is coupled in series with the capacitor C) is reduced. Moreover, if the semiconductor switch S can provide sufficient resistance, the one or more resistors, such as resistor R in FIG. 1, may be eliminated in some embodiments of this disclosure.

As shown in FIG. 1, the power circuit 102 may include a second output terminal 108. Alternatively, the second output terminal 108 may be omitted. In that event, the one or more LEDs $D_1$-$D_N$ may be coupled between the output terminal 106 and another terminal, such as a reference (e.g., ground) terminal.

The control circuit 104 may include analog and/or digital components. In some embodiments, the control circuit 104 includes one or more digital processors, such as digital signal processors (DSPs), for controlling operation of the power circuit 102.

The power circuit 102 may be a switched mode power supply (SMPS), a linear power supply, or any other suitable power supply.

If the power circuit 102 is a switched mode power supply, the control circuit 104 is preferably configured to operate the power circuit 102 in a current control mode (e.g., a constant current mode) when one or more LEDs $D_1$-$D_N$ are coupled to the output terminal 106, and in a voltage control mode (e.g., a constant voltage mode) when no LEDs are coupled to the output terminal 106. In particular, the control circuit 104 is preferably configured to switch operation of the power circuit 102 from the current control mode to the voltage control mode in response to detecting an open circuit condition at the output terminal 106.

Further, the control circuit 104 may be configured to reduce a current setting for the current control mode from a first current level to a second (lower) current level when (or shortly after) switching operation of the power circuit 102 from the current control mode to the voltage current mode. Additionally, the control circuit 104 may be configured to switch operation of the power circuit 102 from the voltage control mode to the current control mode, and operate in the current control mode at the second (lower) current level, in response to detecting one or more LEDs $D_1$-$D_N$ have been coupled to the output terminal 106. In this manner, the control circuit may limit the amount of current supplied to the LED(s) when the LED(s) are initially coupled to the output terminal 106 to prevent damaging the LED(s).

The second current level may be any suitable current level lower than the first current level. For example, the second (lower) current level may be less than five percent (5%) of a maximum current rating of the driver circuit 100.

Thereafter, the control circuit 102 may increase the current setting for the current control mode from the second (lower) current level to the first (higher) current level (i.e., gradually or instantaneously). It should be understood that this aspect of the present disclosure may be employed in LED driver circuits independently of other aspects (e.g., regardless of whether the control circuit 104 is configured to selectively couple a resistance in series with the capacitor C as described above).

As further explained below, the control circuit 104 may be configured to compare a voltage at the output terminal 106 with a reference voltage to determine whether one or more LEDs $D_1$-$D_N$ are coupled to the output terminal 106. For example, the voltage at the output terminal 106 may increase when LED(s) $D_1$-$D_N$ are decoupled from the output terminal. Thus, by comparing the voltage at the output terminal 106 with a suitable reference voltage, the control circuit 104 can detect an open circuit condition at the output terminal 106, or when one or more LEDs $D_1$-$D_N$ have been coupled to the output terminal 106, etc. Alternatively, other suitable means may be employed by the control circuit 104 for determining whether one or more LEDs $D_1$-$D_N$ are coupled to the output terminal 106.

When one or more LEDs $D_1$-$D_N$ are coupled to the output terminal 106, the driver circuit 100 and the one or more LEDs $D_1$-$D_N$ collectively form an LED circuit. The one or more LEDs $D_1$-$D_N$ may include an LED or multiple LEDs from various suppliers or from the same supplier. Additionally, the one or more LEDs $D_1$-$D_N$ may include LEDs having different rated temperature ranges or the same rated temperature range.

Figure 4:
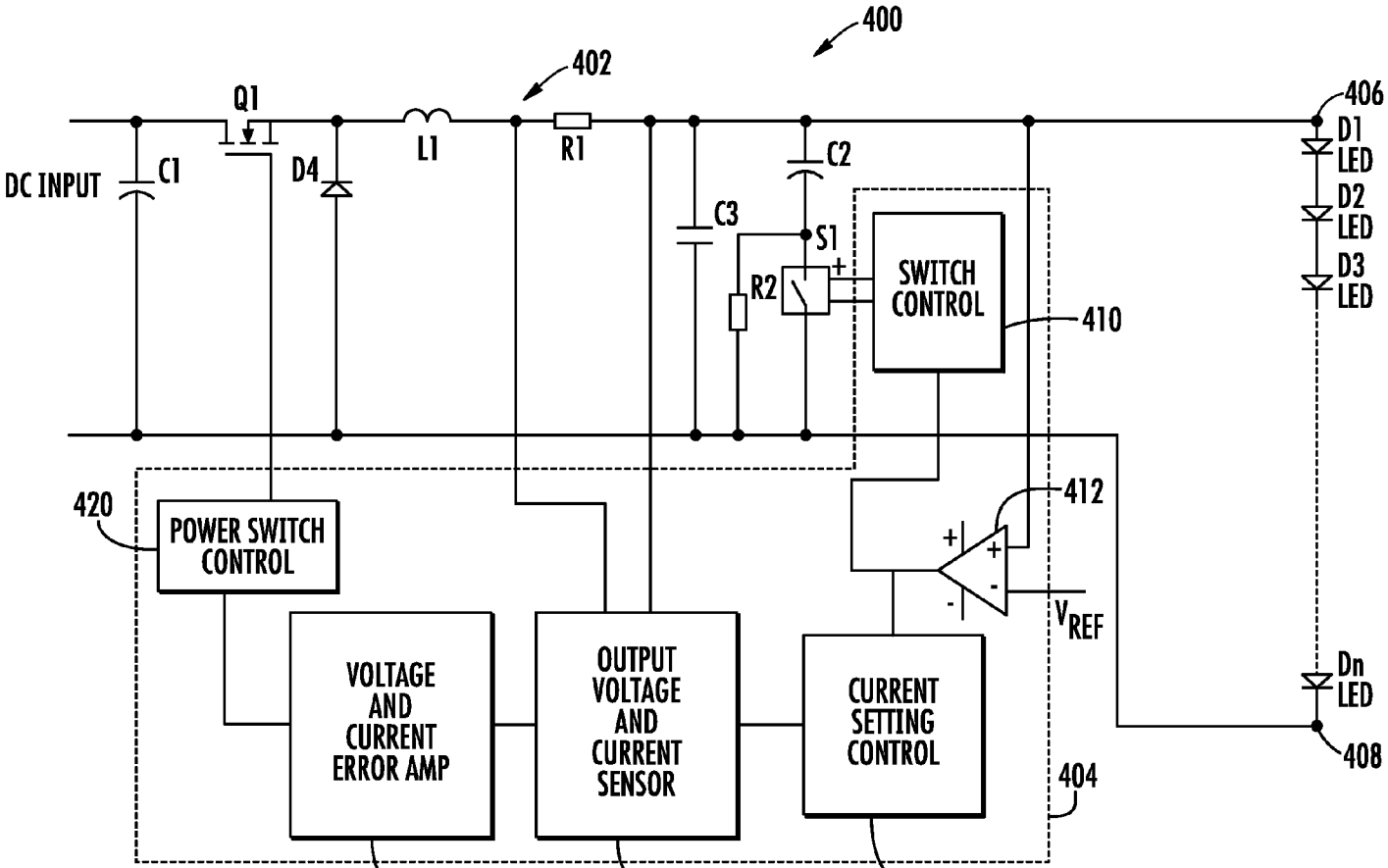
FIG. 4 is a circuit diagram of an LED driver circuit according to another example embodiment of the present disclosure.

FIG. 4 illustrates a driver circuit 400 according to another example embodiment of the present disclosure. The driver circuit 400 includes a power circuit 402 and a control circuit 404 coupled to the power circuit 402 for controlling the power circuit 402. The power circuit 402 includes output terminals 406, 408 to which one or more LEDs $D_1$-$D_N$ may be coupled. The power circuit 402 further includes a capacitor C2 coupled to the output terminal 406, a resistor R2 and a switch S1.

The power circuit 402 employs a flyback converter topology with a DC voltage input. However, other suitable flyback configurations may be employed, as can other suitable power converter topologies (e.g., resonant converters, forward converters, half bridge converters, full bridge converters, etc.) without departing from the scope of this disclosure.

The control circuit 404 may include a switch control 410 coupled to the switch S1 and a comparator 412 coupled to the switch control 410. The comparator 412 is configured to compare an output voltage of the driver circuit 400 with a reference voltage $V_{REF}$ that is set slightly above the expected output voltage when one or more LEDs $D_1$-$D_N$ are coupled to the output terminals 406, 408, and slightly below the open circuit voltage.

In this particular embodiment, the expected output voltage when the LEDs $D_1$-$D_N$ are connected is 14V, the open circuit voltage when no LEDs are connected is 17V, and the reference voltage $V_{REF}$ is 16.5V.

If the output voltage is below the reference voltage $V_{REF}$ (e.g., because the one or more LEDs $D_1$-$D_N$ are coupled to the output terminals 406, 408), the switch control 410 closes the switch S1 to reduce the resistance in series with the capacitor C2 to zero (i.e., shunting the resistor R2).

Conversely, if the output voltage is above the reference voltage $V_{REF}$, the switch control 410 opens the switch S1. Accordingly, the resistor R2 is coupled in series with the capacitor C2 to limit the flow of current from the capacitor C2 to the output terminal 406 when one or more LEDs are subsequently connected.

The control circuit 404 further includes a current setting control 414, an output voltage and current sensor 416, a voltage and current error amplifier 418 and a power switch control 420. The current setting control 414 is coupled to the comparator 412 and the output voltage and current sensor 416. The voltage and current error amplifier 418 is coupled to the output voltage and current sensor 416 and the power switch control 420.

The control circuit 404 is configured to operate the power circuit 402 in current control mode when the LEDs $D_1$-$D_N$ are connected. Further, the control circuit 404 is configured to switch operation of the power circuit 402 from the current control mode to a voltage control mode, and reduce a current setting for the current control mode from a first current level to a second current level, in response to detecting an open circuit condition at the output terminals 406, 408. In particular, the comparator 412 outputs a signal to the current setting control 414 to reduce a current setting for the current control mode from a first current level to a second current level (e.g., below five percent (5%) of the maximum current rating of the driver circuit 400).

When the LEDs $D_1$-$D_N$ are subsequently coupled to the output terminals 406, 408, the capacitor C2 will discharge low current, dictated by the value of the resistor R2, into the LEDs $D_1$-$D_N$. Additionally, the driver circuit 400 will supply low current (i.e., at the second current level) to the one or more LEDs $D_1$-$D_N$. In this manner, a large current spike in the LED string is avoided. About the same time, the output voltage will fall below the reference voltage $V_{REF}$, causing the comparator 412 to close the switch S1, and causing the current setting control 414 to increase the current setting for the current control mode from the second current level to the first current level (i.e., the desired constant current level for the LEDs under normal operating conditions).

Figure 5:
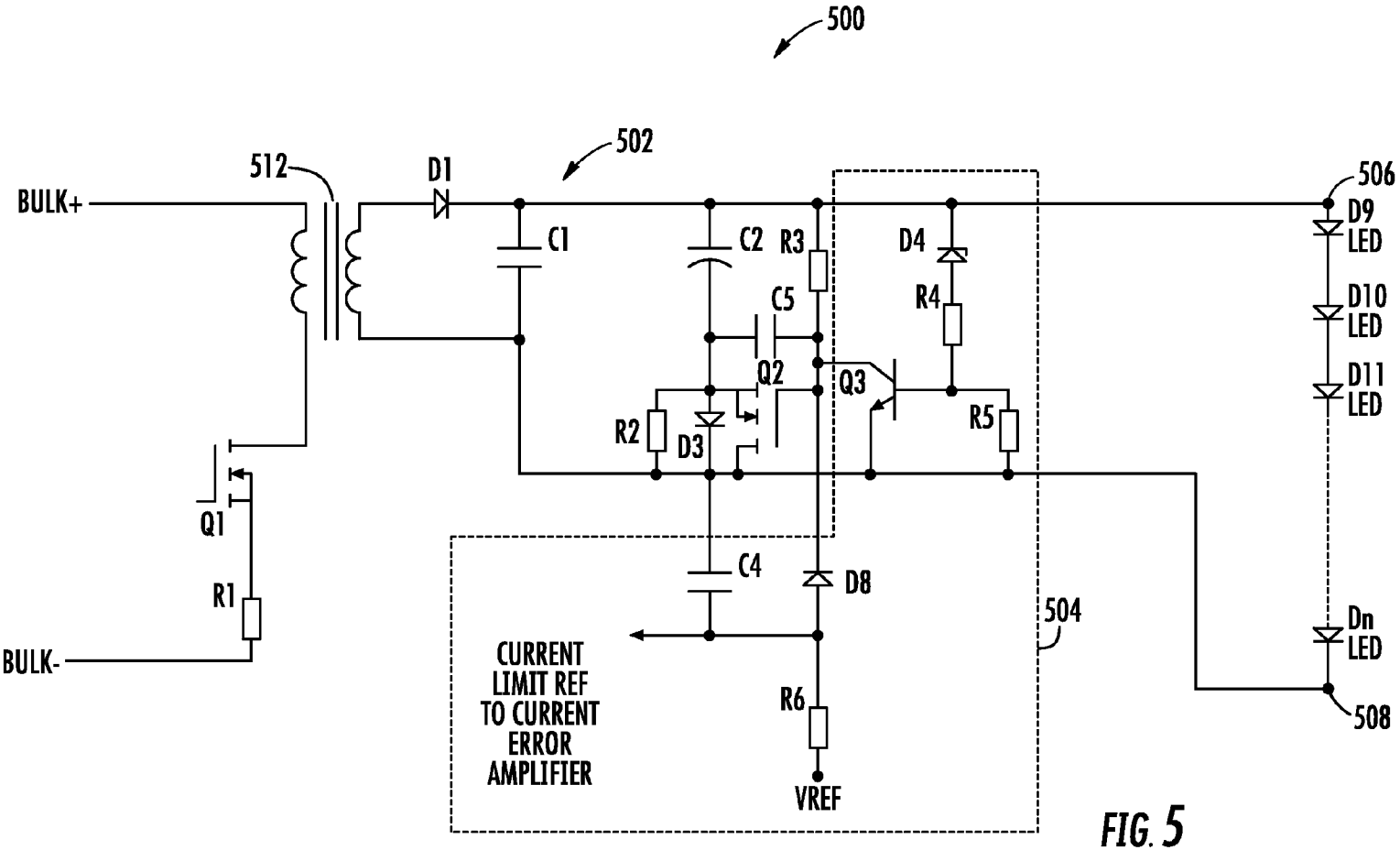
FIG. 5 is a circuit diagram of an LED driver circuit according to yet another example embodiment of the present disclosure.

FIG. 5 illustrates a driver circuit 500 according to another example embodiment of the present disclosure. The driver circuit 500 includes a power circuit 502 has a flyback topology. Alternatively, other power converter topologies may be employed. The driver circuit 500 also includes a control circuit 504 coupled to the power circuit 502.

As shown in FIG. 5, the power circuit 502 includes output terminals 506, 508 to which one or more LEDs $D_9$-$D_N$ may be coupled. The power circuit 502 further includes a capacitor C2 coupled to the output terminal 506, a resistor R2 and a MOSFET switch Q2. Additionally, the power circuit 502 includes a coupled inductor 512, a switch Q1, a rectifier D1 (e.g., a diode), and a capacitor C1. The switch Q1 is selectively operated by the control circuit 504. The capacitor C1 is coupled to the rectifier D1. The control circuit 504 includes a zener diode D4 coupled to a switch Q3 via a resister R4. The switch Q3 is coupled to the switch Q2.

When the LEDs $D_9$-$D_N$ are being driven, the output voltage of the driver circuit 500 is below the break down voltage of the zener diode D4, which is used as a comparator. Accordingly, the switch Q3 is off and the gate of the MOSFET switch Q2 is driven high to saturate the MOSFET Q2. The output filter capacitor C2 charges and discharges through MOSFET switch Q2. Since switch Q2 handles only the ripple current of the capacitor C2, the power loss through switch Q2 is relatively negligible. When the LEDs are disconnected from the output terminals 506, 508, the output voltage rises to 17V and zener diode D4 conducts. This forces switch Q3 to saturate and slowly turn off MOSFET switch Q2 through resistor R2. Thus, the resistor R2 is now inserted in series with capacitor C2. Additionally, the output current setting of the driver circuit 502 is reduced to a lower level by pulling the Current Limit Reference to a lower value due to current flow through diode D8 and the voltage drop across resistor R6.

When the LEDs D9-Dn are connected while the driver circuit 500 is still energized, the capacitor C2 discharges into the LEDs at very low current, limited by resistor R2. The driver circuit 500 also provides much lower current due to the reduced current limit. A small capacitor C1 is connected directly at the output rectifier D1 to clamp the flyback rectifier for controlling the voltage spikes on the primary switch Q1, but such stresses are negligible as the power circuit 502 is now operating at a very low power level. Since the value of capacitor C1 is small, the current spike injected by it in the LEDs D9-Dn is negligible. When the output voltage falls below 16V, the switch Q3 turns off and MOSFET switch Q2 turns on slowly in linear mode due to a larger time constant for its gate threshold set by resistor R3 and capacitor C5. At the same time, the current limit is also raised to its original rated level slowly using the soft start provided by capacitor C4 until full rated current is provided to the LEDs D9-Dn.

Alternatively, the driver circuit 500 may be regulated on a primary side of the coupled inductor 512 (or transformer, if other topologies are used). In that event, the output voltage may be detected using a primary sense winding and a signal corresponding to the output voltage may be used to reduce a current limit for a current control mode by injecting a DC signal to the current sense signal.

The example embodiment of FIG. 5 illustrates the theory of operation in a simplistic way. It should be understood that more sophisticated circuits can be readily designed using suitable comparators, references and time delays while incorporating sufficient hysteresis. These solutions can handle large variations in LED forward voltage drops due to specifications, temperature and batches while meeting design objectives.

Figure 6:
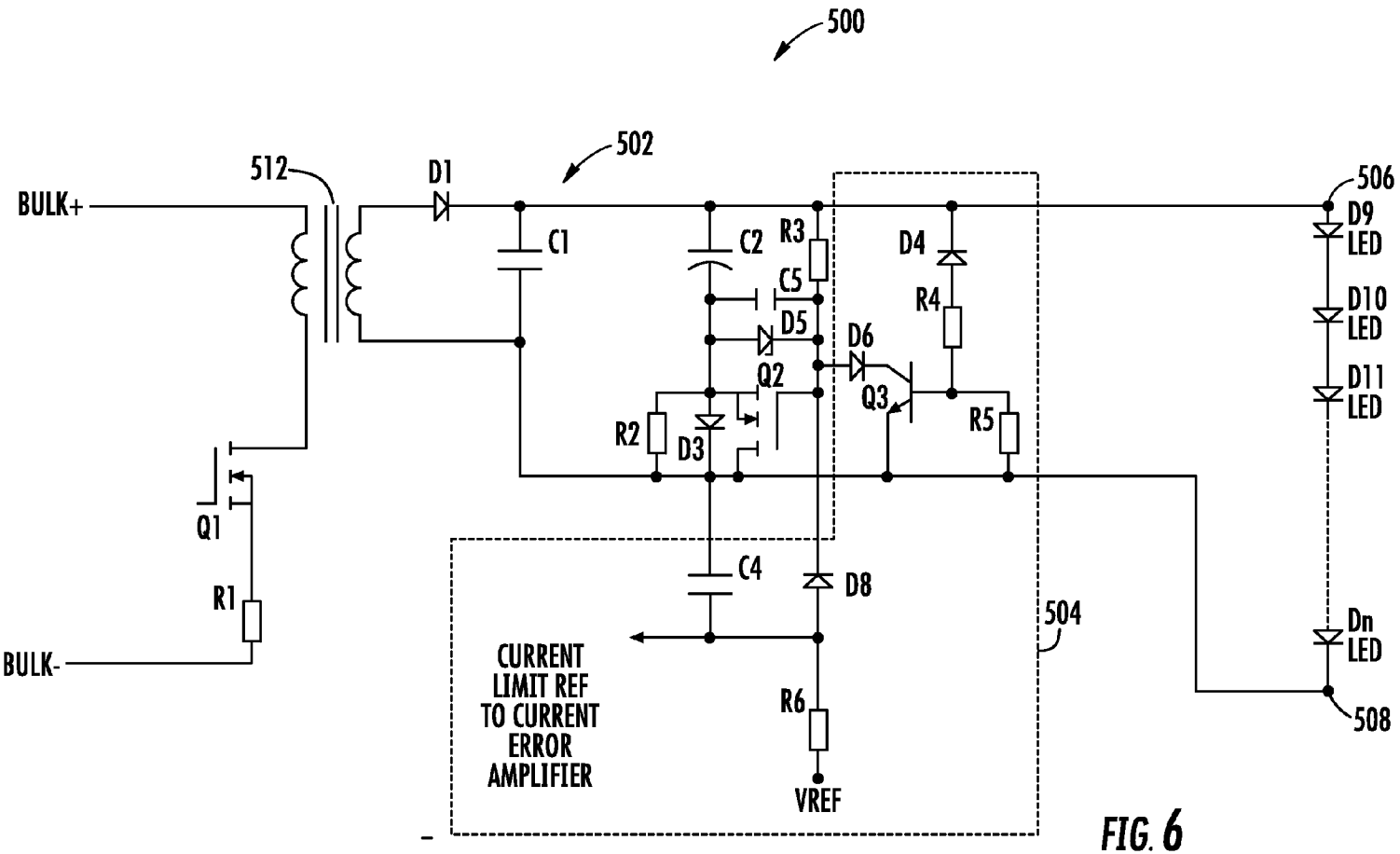
FIG. 6 is a circuit diagram of an LED driver circuit according to still another example embodiment.

FIG. 6 illustrates a driver circuit 600 according to another example embodiment. The driver circuit 600 of FIG. 6 is similar to the driver circuit 500 of FIG. 5, but also includes a zener diode D5 and another diode D6. The zener diode D5 is coupled between the gate and the source of MOSFET switch Q2 for protecting the MOSFET switch Q2 from a high input voltage. In some embodiments, the high input voltage may be 20V or greater. Additionally, the diode D6 is coupled between the emitter of BJT switch Q3 and the capacitor C5 to prevent current from the switch Q3 from charging the capacitor C5. If the voltage across capacitor C5 is greater than the voltage at the gate of MOSFET switch Q2 in the driver circuit 500 of FIG. 5, capacitor C5 may discharge excessive current to and damage the LEDs $D_9$-$D_N$. For this reason, the diode D6 is included in the driver circuit 600 of FIG. 6 to inhibit capacitor C5 from charging to a voltage greater than the voltage at the gate of MOSFET switch Q2.

Further, various embodiments of the present disclosure may be implemented using application specific integrated circuit (ASICs). Accordingly, a current discharged from a capacitor (e.g., the capacitor C of FIGS. 1-3, C2 of FIG. 4, or C2 of FIG. 5) may be controlled on a secondary side of a power circuit while a current limit for a current control mode is controlled on a primary side of the power circuit. Thus, a driver circuit may be regulated on a primary side or a secondary side of a power circuit, or on both the primary side and the secondary side of the power circuit.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A driver circuit for one or more LEDs, the driver circuit comprising:

a power circuit having an output terminal, a capacitor coupled to the output terminal and a switch; and a control circuit coupled to the power circuit for controlling the power circuit, the control circuit configured to operate the switch for coupling a resistance in series with the capacitor in response to detecting an open circuit condition at the output terminal.

2. The driver circuit of claim 1 wherein the control circuit is configured to compare a voltage at the output terminal with a reference voltage to determine whether one or more LEDs are coupled to the output terminal.

3. The driver circuit of claim 1 wherein the power circuit comprises a switched mode power supply, and wherein the control circuit is configured to switch operation of the switched mode power supply from a current control mode to a voltage control mode, and reduce a current setting for the current control mode from a first current level to a second current level, in response to detecting an open circuit condition at the output terminal.

4. The driver circuit of claim 3 wherein the control circuit is configured to switch operation of the switched mode power supply from the voltage control mode to the current control mode, and operate in the current control mode at the second current level, in response to detecting one or more LEDs have been coupled to the output terminal.

5. The driver circuit of claim 4 wherein the control circuit is configured to increase the current setting for the current control mode from the second current level to the first current level after switching operation from the voltage control mode to the current control mode.

6. The driver circuit of claim 5 wherein the control circuit is configured to gradually increase the current setting for the current control mode from the second current level to the first current level after switching operation from the voltage control mode to the current control mode.

7. The driver circuit of claim 1 wherein the control circuit is configured to reduce the resistance in series with the capacitor in response to detecting one or more LEDs have been coupled to the output.

8. The driver circuit of claim 7 wherein the power circuit further includes at least one resistor, and wherein the resistance is provided, at least in part, by the resistor.

9. The driver circuit of claim 8 wherein the resistor is coupled in parallel with the switch.

10. The driver circuit of claim 8 wherein the switch is a semiconductor switch.

11. The driver circuit of claim 10 wherein the resistance is provided, at least in part, by the switch.

12. The driver circuit of claim 11 wherein the switch is a MOSFET switch, and wherein the control circuit is configured to operate the MOSFET switch in linear mode to gradually increase conduction through the MOSFET switch and reduce the resistance in series with the capacitor in response to detecting one or more LEDs have been coupled to the output terminal.

13. The driver circuit of any of claim 8 wherein the switch is an electromechanical switch.

14. The driver circuit of claim 13 wherein the electromechanical switch has first and second positions, and wherein the resistor is coupled in series with the capacitor when the electromechanical switch is in the first position and bypassed by the electromechanical switch when the electromechanical switch is in the second position.

15. A driver circuit for one or more LEDs, the driver circuit comprising:

a switched mode power supply having an output terminal; and a control circuit coupled to the switched mode power supply for controlling the switched mode power supply in a current control mode or a voltage control mode, the control circuit configured to switch operation from the current control mode to the voltage control mode, and reduce a current setting for the current control mode from a first current level to a second current level, in response to detecting an open circuit condition at the output terminal.

16. An LED circuit comprising the driver circuit of claim 15 and one or more LEDs coupled to the output terminal of the driver circuit.

17. The driver circuit of claim 15 wherein the control circuit is configured to switch operation from the voltage control mode to the current control mode, and operate in the current control mode at the second current level, in response to detecting one or more LEDs have been coupled to the output terminal.

18. The driver circuit of claim 17 wherein the driver circuit has a maximum current rating, and the second current level is less than five percent (5%) of the maximum current rating.

19. The driver circuit of claim 17 wherein the control circuit is configured to increase the current setting for the current control mode from the second current level to the first current level after switching operation from the voltage control mode to the current control mode.

20. The driver circuit of claim 19 wherein the control circuit is configured to gradually increase the current setting for the current control mode from the second current level to the first current level after switching operation from the voltage control mode to the current control mode.

* * * * *